US005875779A

United States Patent [19]

Fuhrman et al.

[11] Patent Number: 5,875,779

[45] Date of Patent: Mar. 2, 1999

[54] ARCUATELY RECIPROCATING HUMAN SEXUAL FITNESS MACHINE

[76] Inventors: Andrew M. Fuhrman; Roxanne S. Fuhrman, both of 119 Edgewater Dr., Edgewater, Md. 21037

[21] Appl. No.: 849,323

[22] PCT Filed: Nov. 23, 1994

[86] PCT No.: PCT/US94/13750

§ 371 Date: May 15, 1997

§ 102(e) Date: May 15, 1997

[87] PCT Pub. No.: WO96/15753

PCT Pub. Date: May 30, 1996

Related U.S. Application Data

[63] Continuation-in-part of Ser. No. 147,842, Nov. 4, 1993, Pat. No. 5,385,154.

[51] Int. Cl.[6] ..... A61G 15/00

[52] U.S. Cl. ..... 128/845; 128/846; 600/38; 297/246

[58] Field of Search ..... 128/845, 846; 297/245, 246; 482/73, 92, 906; 114/363; 440/21, 90, 104; 600/38–41

[56] References Cited

U.S. PATENT DOCUMENTS

| | | | |
|---|---|---|---|
| 4,825,855 | 5/1989 | Kundson | 600/38 |
| 5,389,062 | 2/1995 | Mitchum | 600/38 |
| 5,453,080 | 9/1995 | Mitchum | 128/845 |
| 5,538,011 | 7/1996 | Craft | 128/845 |
| 5,704,894 | 1/1998 | Boutos | 600/38 |
| 5,782,243 | 7/1998 | Bisyak | 600/38 |

*Primary Examiner*—Michael A. Brown
*Attorney, Agent, or Firm*—Lalos & Keegan

[57] ABSTRACT

The invention is an arcuately reciprocating human sexual fitness machine having male and female seats from which the female occupant may pivot and reciprocate along an arcuate path forwardly about a horizontal axis toward and away from the other seat, and may also reciprocate along a horizontal path. Counterbalancing of the female seat provides a levitating effect as the seat pivots forward. The machine provides a device for a male and female couple to engage in intercourse while both are seated, and able to be in complete and uninterrupted frontal contact upwardly from the genital region. The female seat is provided with an integral upper high restraint, a remote abutting surface for contact with the occupant of the male seat and is bifurcated to produce an open center for sexual access with a sitting surface forward of the horizontal pivoting axis of the seat.

58 Claims, 6 Drawing Sheets

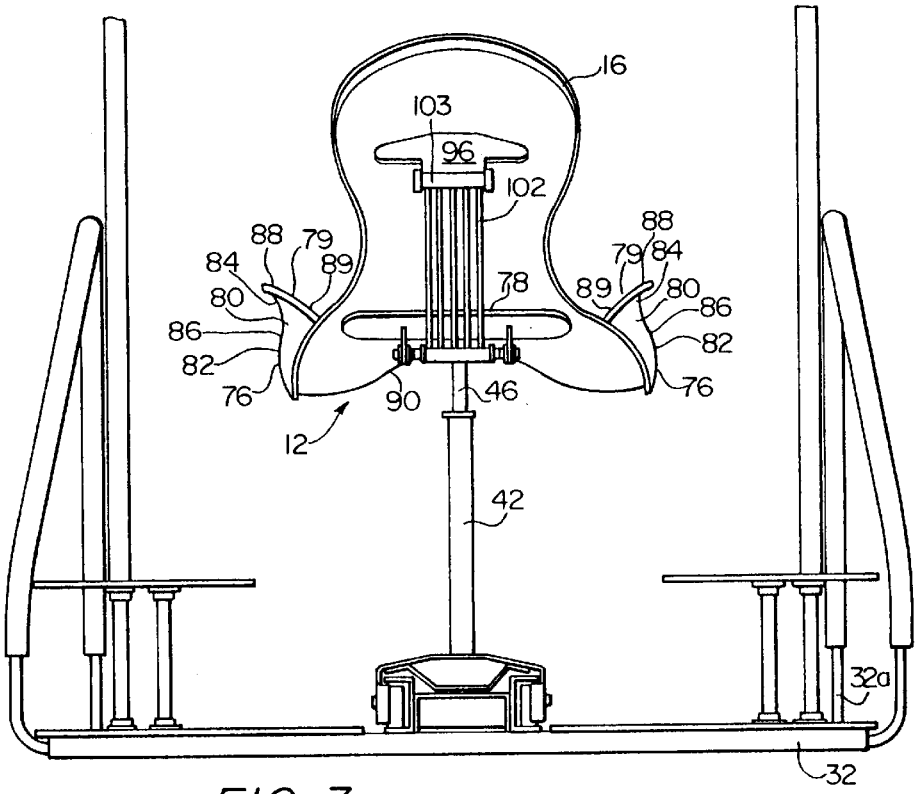
FIG. 3
FIG. 4
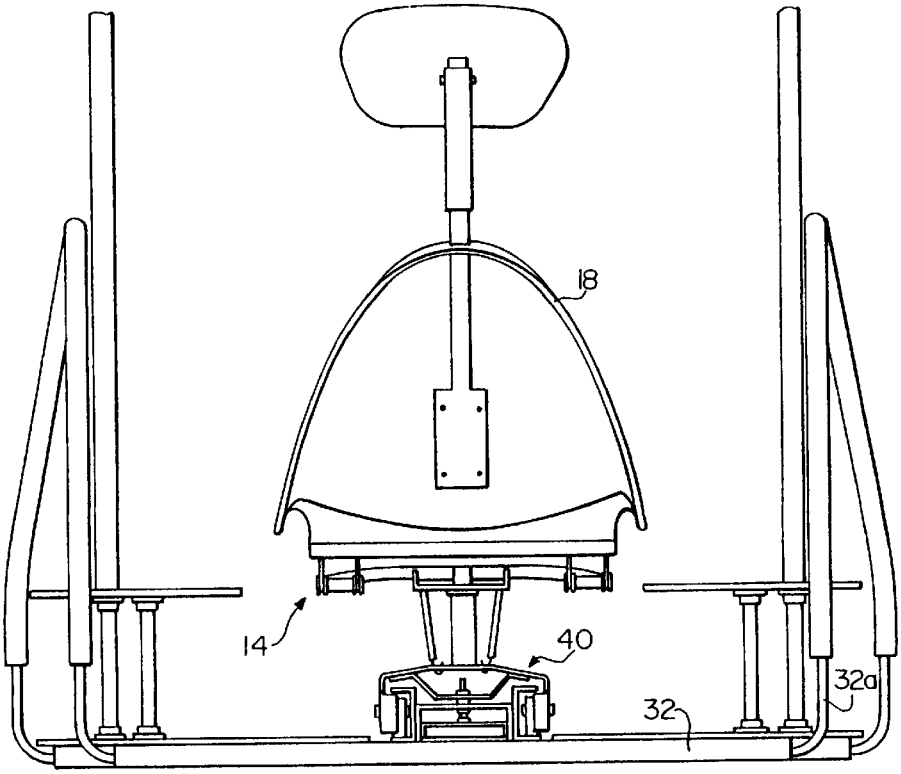

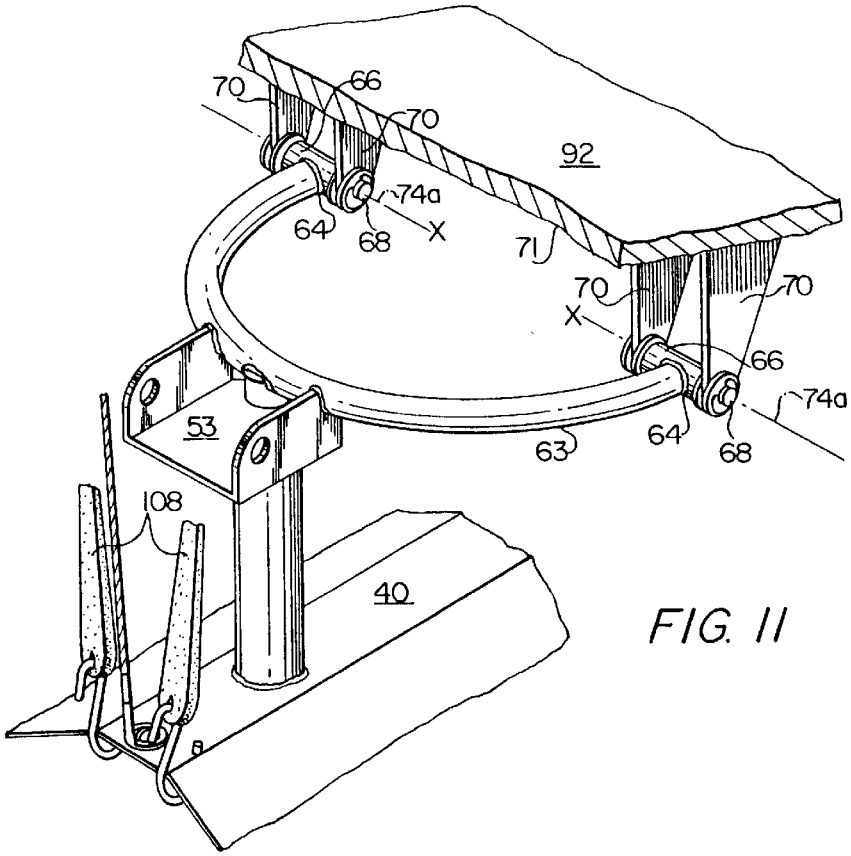
FIG. 11
FIG. 8
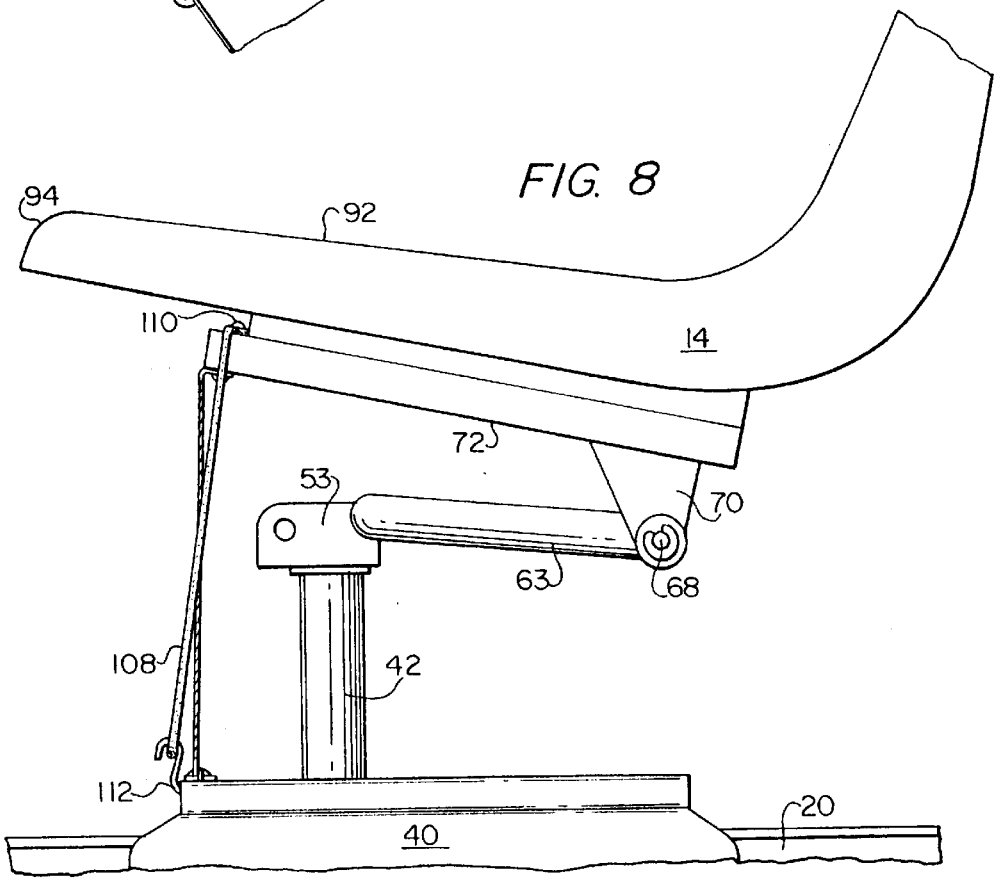

ARCUATELY RECIPROCATING HUMAN SEXUAL FITNESS MACHINE

PRIOR APPLICATIONS

This application is a continuation-in-part of parent application Ser. No. 08/147,842 filed Nov. 4, 1993 entitled "The Couple's Intimacy Chair Assembly, now U.S. Pat. No. 5,385,154.

BACKGROUND

At the present time and through all recorded history, a bed of one form or another has been the place where human couples have had sexual intercourse. It requires that both individuals support their own weight and often bear the weight of their partner, requiring great expenditure of energy as well as the use of the hands and considerable body control, just to gain advantageous access to one another.

Beds are disadvantageous and restricting due to difficulties in achieving and maintaining a favorable position for a sustained period. Sexual intimacy on a conventional bed requires a great expenditure of energy due to the bed's limitations. Persons of decreased or diminished physical ability may not be able to function well or at all in a bed. Generally, beds restrict access to one another due to the mechanical difficulties a two dimensional mattress surface presents the couple.

The desire or need for intimacy remains a strong impulse for couples but the energy, strength and balance requirements may limit or destroy a couple's chance for intimacy. Those who are aged, infirm, handicapped, such as through loss of a limb, for example, or otherwise physically unable to engage in sexual intercourse with their partner to the extent desired present a real need that has not been fulfilled in the past. This lack of engagement in sexual relations is troubling for many couples not only psychologically but also physiologically as it often renders their musculature less fit to undergo the perceived rigors of such a union in the couple's future.

In the above parent copending application, there was an attempt to meet the needs of many couples but the movements permitted and the ease of use still could be improved. The present invention seeks to achieve these goals.

SUMMARY OF THE INVENTION

This invention provides a human sexual fitness system for a human couple for not only overcoming many of the mechanical and physical difficulties in achieving and maintaining an advantageous position during sexual intercourse but also provides the means for improving a couple's fitness for engaging in sexual union. It further provides the couple with a means of a new enhancement: selectively controlled and mutually facing seats to support the man and the woman in raised positions; at least the female or both individuals being able to select to pivot about a horizontal axis and move arcuately toward and away from each other and further, at least the female may additionally move in continuous reciprocal and substantially longitudinal motion. The couple experiences a new ability to create and control movement with little or no effort during intercourse that cannot be achieved and maintained in a bed. They exert negligible energy in supporting their bodies while improving their functional performance. A seat for the female is bifurcated with an open center forming seat legs. A sitting surface is positioned on the seat forwardly of the pivot axis to permit the female to tilt and move along an arcuate path forwardly.

A leg restraint for the female is provided to overlay her leg and retain her on the seat with her legs comfortably spread apart. At least the female seat may be counterbalanced to the weight of the seat occupant to provide a floating effect. The surface of the leading edge of the female seat restraint is contoured to abut the torso of the male in order to promote the couple's union.

BRIEF DESCRIPTION OF THE DRAWINGS

FIG. 3 is an end view of the female seat in perspective and partially broken away illustrating the reciprocating capability of the seat, the counterbalancing means, the leg restraints with abutting surface for contact with the male and also the supporting mechanism including the dolly for travelling on the rail.

FIG. 4 is an end elevational view partly broken away of the male seat to illustrate the supporting mechanism for the seat and also the wheel construction to permit the seat to roll along the rail.

FIG. 8 is a side elevational view partly broken away of the male seat illustrating both the counterbalancing means and the non-extensible limit cord secured to the male seat.

FIG. 11 is an enlarged perspective view taken along lines 11—11 of FIG. 1 and partly broken away illustrating the pivoting means, counterbalancing means and the nonextensible limit cord attached to the male seat.

DESCRIPTION OF THE PREFERRED EMBODIMENT

Figure 1:
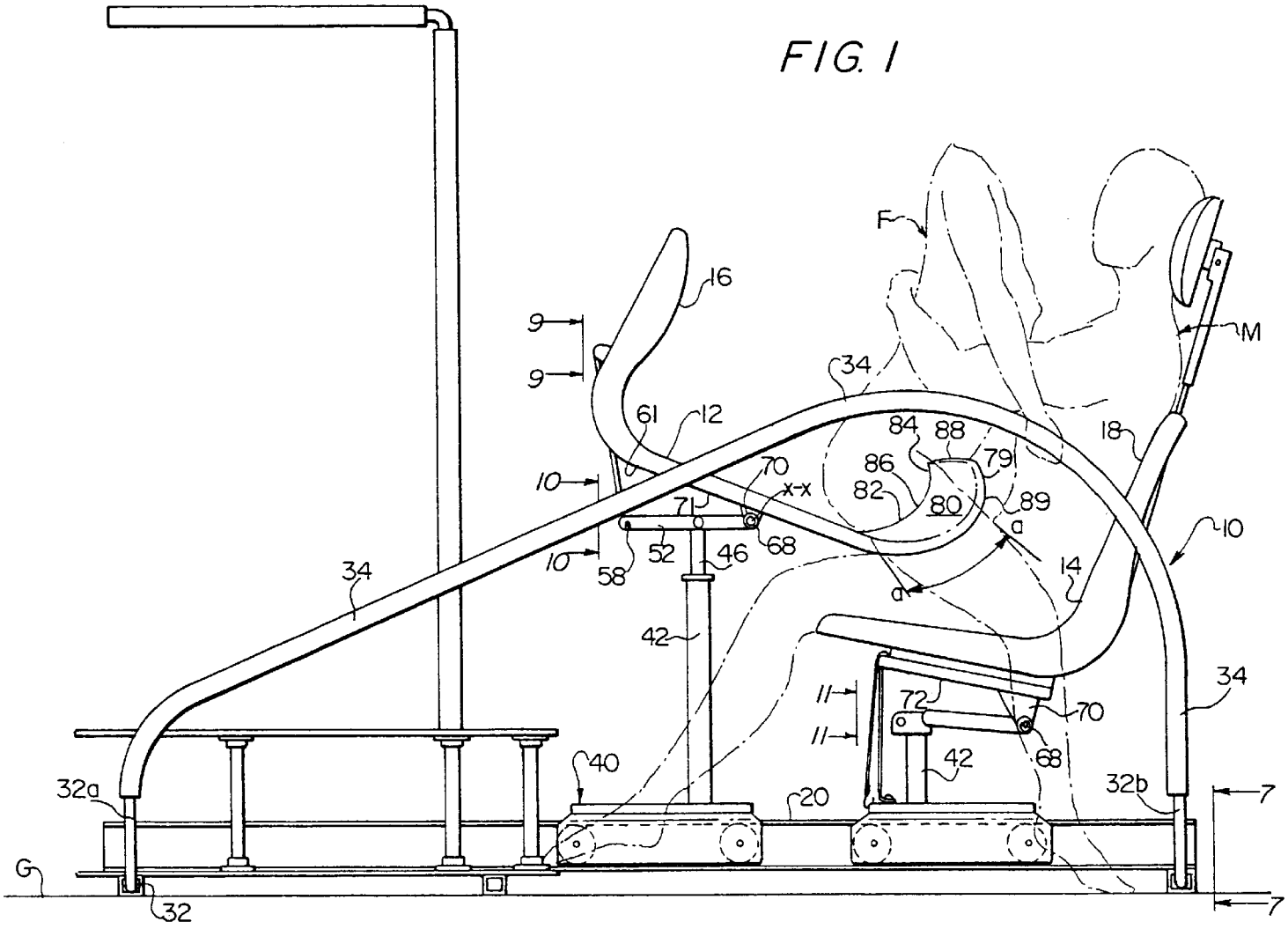
FIG. 1 is a side elevational view of the arcuately reciprocating human sexual fitness machine of the present invention illustrating both the position of the couple in their facing chairs in which the female seat is higher and overlaps the male seat and the female seat tilted towards the male and also the track enabling reciprocal linear movement along the track by the occupant of at least the female seat.

The present invention is a human sexual fitness machine that allows greater mobility, comfort and ease of the mechanics of sexual intimacy and intercourse while reducing the effort to be expended and also at the same time providing the means to achieve improved fitness and function of either or both the male and female participants. In accordance with the present invention, the female occupant has the ability to move significantly in a reciprocating arcuate path towards and away from the male seated in front of and below the female. Her travel can be along an arc that may be six or more inches while at the same time her weight is diminished substantially through levitating her weight as she moves forward with counterbalancing forces yet she retains control of her movements as she may lean forward to tilt her sexual organ forwardly and downwardly and then reverse. She is also in accordance with the present invention able to place her feet either on the floor or other support or to simply hover over the seated male with her feet off any support and lean and tilt forwardly and downwardly and then back and away toward an upright position and continue this arcuate reciprocating movement as long as she desires to do so.

The invention is particularly designed for the operation and control of the female, though the participation of the male is in an active manner. The female may maintain and select any elevation as long as she desires and may move forwardly or backwardly independently and simultaneously should she wish to do so. It is notable, as will be determined with a careful study of the following description, the present invention will permit the female to move her torso in an arcuate path downwardly and forwardly and up and back in a manner typically thought primarily to be the movement of the male and in doing so she may be able to attain a "stroke" of about 18 inches while engaged in coitus. As the female moves arcuately forward and downward to engage in coitus, both parties may move longitudinally simultaneously, the female forwardly, the male rearwardly. Then, the two may travel forwardly simultaneously, as the female pivots simultaneously arcuately up and away. They may travel 12 inches or more longitudinally, and 6 inches arcuately.

Any female can through the use of the present invention achieve an improved sexual function as related to mobility, endurance, reduced energy requirement, accessibility to her mate, body control with improved use of muscle groups and enhanced fitness to participate in intercourse. All these benefits are attained by reason of the ability to achieve a greater degree of efficient motion along with the ability to control her motions including the depth of penetration. The female can, in accordance with the present invention, take active control of the sexual act. While the male actively participates, the female is uniquely able to be a dominant controller of the act of intercourse.

The male participating in the act may be stationary, or immobile, or he may be active. In either case he plays a very substantial part in the method of the present invention to achieve mutual satisfaction. The male's energy is also conserved because he is seated while he may also be able to move along an arcuate path beneath the female in the act of coitus. The male seat may be positioned in front of its horizontal pivot axis to effect an up and down arc. By permitting the male to tilt rearwardly from upright about a horizontal axis and with a counter-balancing levitation control, the couple can move as one. Each seat is levitated and positioned to tilt in unison in similar or varied arcuate paths as desired for mutual satisfaction.

In FIG. 1 there is shown the human sexual fitness machine of the present invention designated as 10 positioned on the ground shown as G. The present invention is similar in many respects to the present applicants" copending application Ser. No. 08/147,842 filed Nov. 4, 1993 as above stated which parent application is incorporated in its entirety in this continuation-in-part application.

As shown in FIG. 1 there is a pair of facing seats 12 and 14 for the female and male respectively. A backrest 16 is provided for the female seat and a backrest 18 is provided for the male seat 14. It should be noted that the female backrest is not essential, but the male backrest is for desired back support. The seats may be covered and padded in any suitable conventional manner for the comfort of the occupants.

Figure 7:
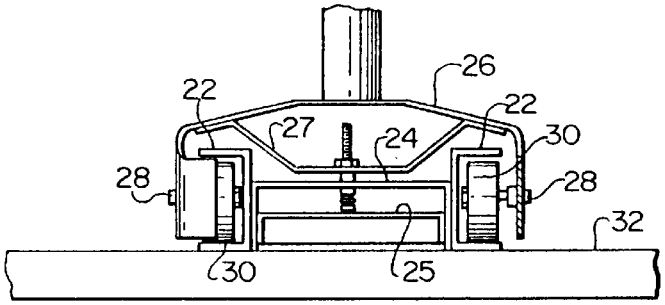
FIG. 7 is an end view partly broken away of the dolly and rail arrangement taken along lines 7—7 of FIG. 1.
Figure 6:
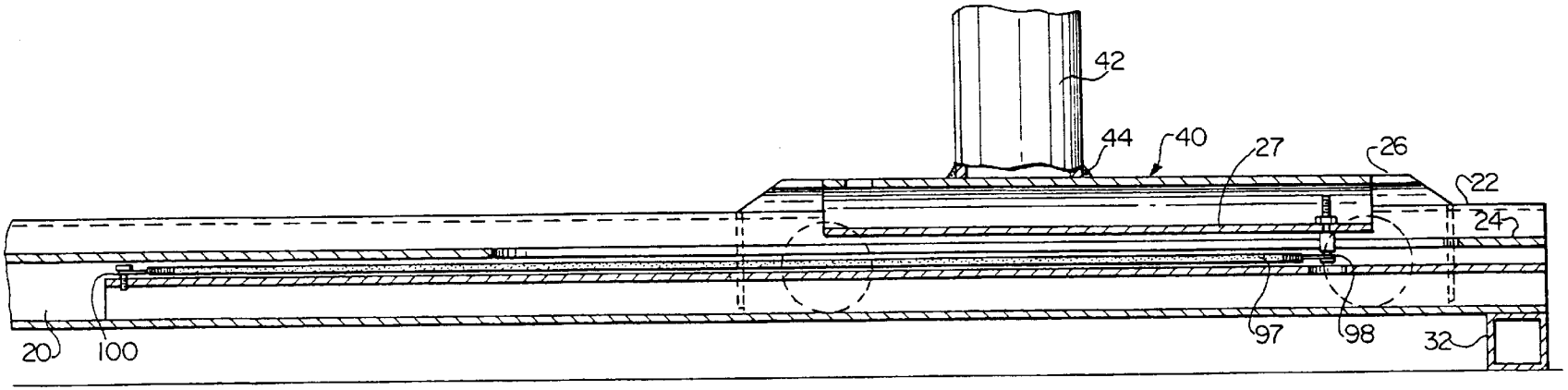
FIG. 6 is an enlarged view of the rail and dolly arrangement taken along lines 6-6 of FIG. 5 and partly broken away.
Figure 9:
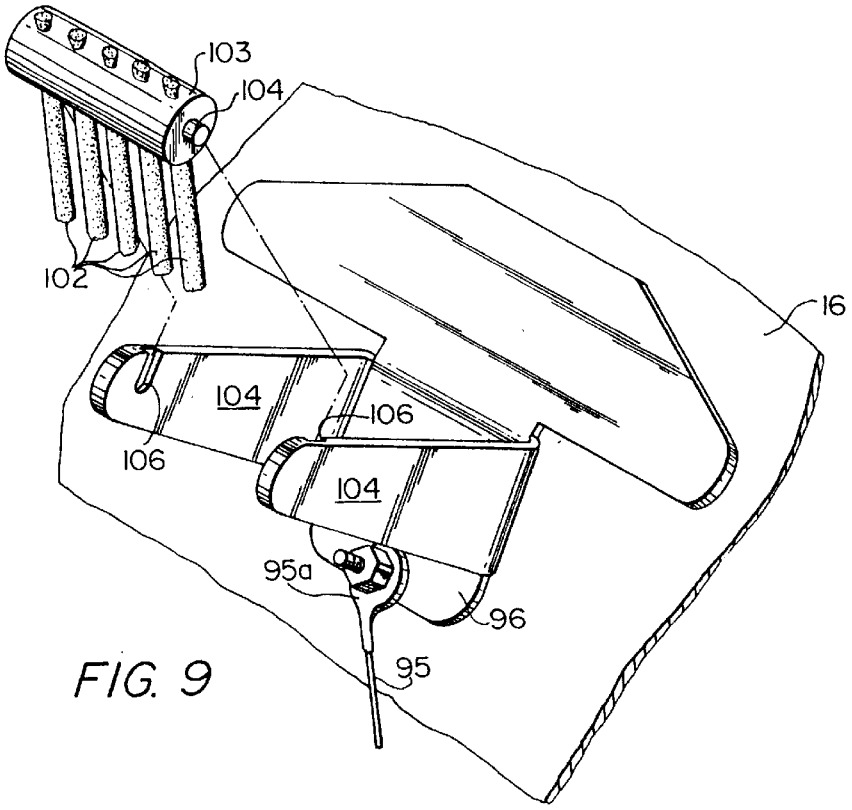
FIG. 9 is an enlarged exploded perspective view partly broken away taken along lines 9—9 of FIG. 1.

As is shown in FIG. 1 the female figure F is sitting in the female seat 12 and the male figure M is sitting in the male seat 14. The seats are supported for longitudinal or rectilinear movement along rail 20 that, as is shown in FIGS. 6 and 7, is composed of a pair of opposed C-shaped bars 22,22 fixed together by superposed connecting plates 24 and 25. A U-shaped housing 26 having an inner wall 27 is positioned around the C bars 22,22 and has journaled therein at 28,28 pairs of rollers 30,30.

The rail 20 is raised from the ground G by support tube 32 that passes beneath rail 20 to substantially beyond the width of the seats 12 and 14 on both sides as shown in FIGS. 3 and 4 and then rises upwardly in an easy curve as shown at 32*a* from behind the female seat and forms a hand railing at 34 on each side of the seats. This railing 34 may be comfortably covered and is to be preferably, although not exclusively, used by the female for support as may be needed. The railing 34 as shown in FIG. 1 rises and then declines from one end of the machine to the other where vertical tubing 32*b* connects with the hand railing 34 to form a unitary support tube 32 to support the rail 20 as best shown in FIGS. 1, 4 and 6. Suitable support levelers (not shown) may be positioned in the corners of the support tube 32 to maintain the machine relatively even on any uneven surface. These levelers may be, for instance, conventional screw threaded bolts having resilient heads (also not shown) for contact with the ground G.

Figure 2:
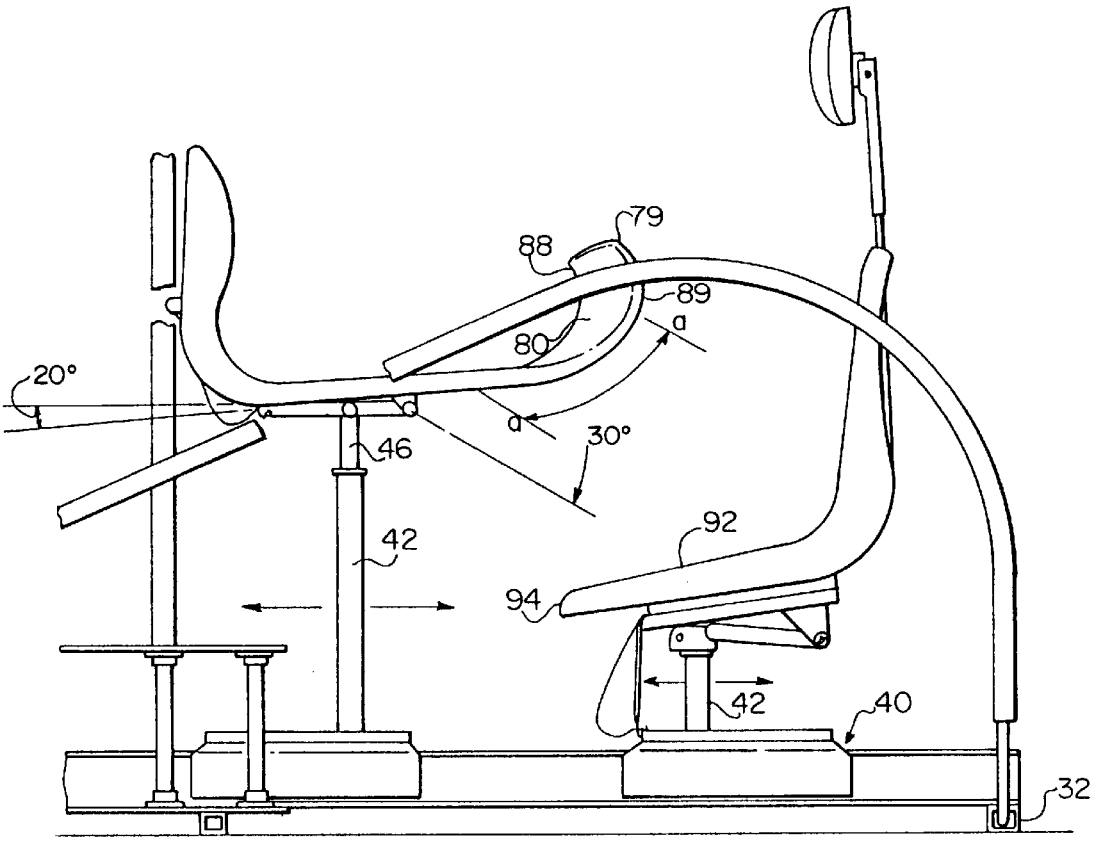
FIG. 2 is a side elevational view of the present invention illustrating in dotted lines the potential movements of the female seat and the male seat wherein each seat sitting surface may move in an arcuate path toward and away as well as reciprocate along a horizontal path.

The housing 26 and the rollers 30,30 together form a dolly assembly 40 for female seat 12 that is identical in structure and function to the rolling support dolly 40 for the male seat 14. The dolly assembly 40 shown is not critical and any suitable ball bearing or sliding mechanism could be substituted therefor. Each seat 12 and 14 is supported in its respective dolly 40,40 as best shown in FIGS. 1, 2, and 6 with a vertical stanchion 42 formed from a hollow tube and secured to the housing 26 as by weldments 44 or otherwise secured thereto. Positioned within the stanchion 42 is rotatable solid pedestal 46. Pedestal 46 may be resiliently urged within the stanchion 42 by means of coiled spring at the lower end of the pedestal (not shown). The same structure is present in the support of the male seat which will have the same rotational movement about the vertical axis of the stanchion 42 and may have some limited vertical movement because of the resiliency of the spring (not shown) within the stanchion 42.

Figure 10:
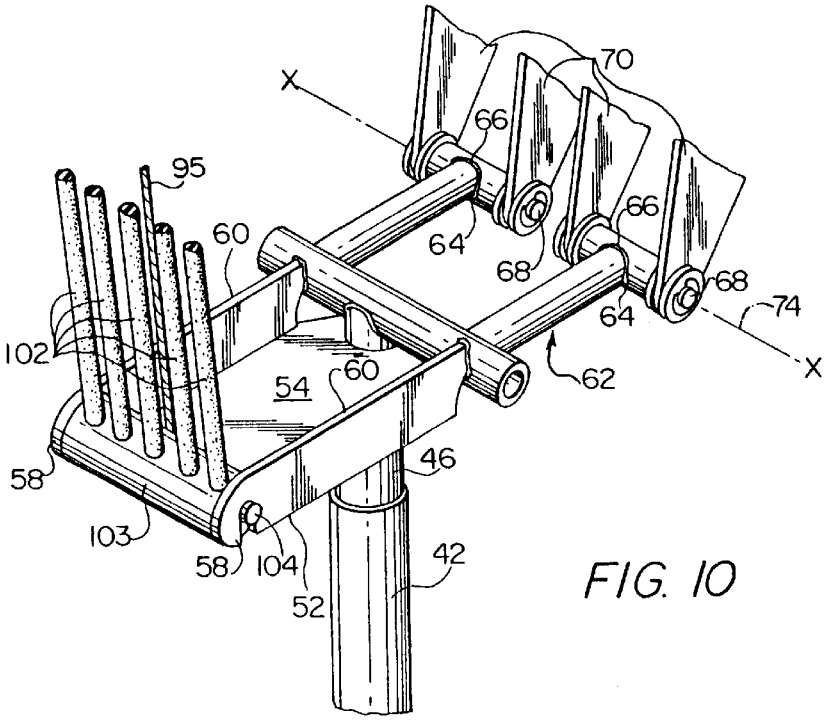
FIG. 10 is an enlarged perspective view taken along lines 10—10 of FIG. 1 and partly broken away of the pivoting means and the counterbalancing means for the female seat.

Welded or otherwise secured to the top of the pedestals 46,46 for the female and male seats respectively are brackets best shown in FIGS. 10 and 11 at 52,53 respectively. With respect to the female seat, bracket 52 may be of any shape other than the U-shaped plate 54 shown in FIG. 10. Bracket 52 is provided with a pair of hooks 58,58 on each side of the plate 54 remote from the pedestal 46 for purposes to be described subsequently. The top surfaces 60, 60 of the edges of the plate 54 serves as an abutting surface for the bottom 61 of the female seat 12.

Also welded to the top of each pedestal 46,46 and fixed to each of the brackets 53,54 are U-shaped yokes 62 and 63 respectively that may be formed from a suitable metal tube that may be continuous as with yoke 63 or composed of several welded parts as yoke 62. Other shapes and constructions are also usable. At the ends 64 of the yokes 62 and 63 are welded pairs of cross tubes 66,66 into which are forced a pair of trunnions 68,68 that permit the rotation of a pair of journaled and opposed extension brackets 70,70 secured at the opposite end to the undersides 71 and 72 of seats 12 and 14 respectively by being molded or otherwise secured thereto. The permitted pivoting of the seat about the horizontal axis 74 formed by the trunnions 68,68 is a particularly desirable feature of the present invention. This pivoting mechanism can be any suitable mechanical means such as a hinge, ball bearing or other sliding or rotatable coupling that performs the same pivoting function. It is the function rather than the mechanism that is important.

The female seat 12 has a unique configuration that enables the female occupant to comfortably and efficiently engage in sexual intercourse while being supported in a manner that brings her to a position from which she can access the male sitting below and in front of her. Unlike a conventional seat, the female seat 12 of the present invention is designed to primarily support the female's buttocks and upper thighs. The seat 12 is also designed to support the female on a forwardmost sitting surface while her uppermost thighs are restrained in a position where her legs are retained comfortably apart at a 45° angle all the while her buttocks are being properly and comfortably supported for sexual access between male and female.

Figure 5:
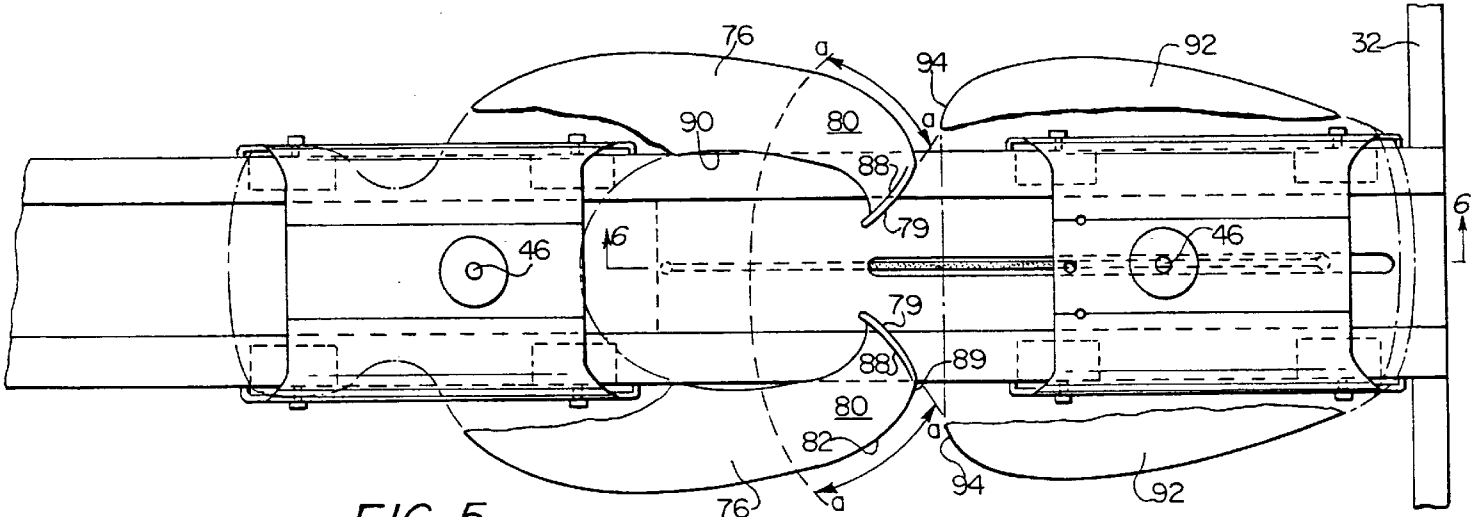
FIG. 5 is a plan view, partly broken away, of the dolly and rail along with the flexible cord urging the male seat, in phantom, forwardly toward the female seat also in phantom.

To accomplish these goals the female seat 12, as best shown in FIGS. 3 and 5, is bifurcated into two protruding upper leg supports 76,76 rigidly connected to a rearward portion 78. The seat 12 includes a sitting position or surface defined on each upper leg support 76 by the portion of the seat shown in FIGS. 1, 2 and 5 and identified as that area between the dotted lines a,a. That portion being the approximate sitting surface of the female and while its exact position is not critical, it is desirable that the sitting surface is positioned forwardly of the axis x,x of the trunnions 68,68 that support the female seat best shown in FIG. 10. By reason of the sitting position a,a being forward of the pivot axis x,x, the female seated in the seat 12 is able to pivot about the axis x,x to affect greater movement than is customary and to provide a means to move toward and away and up and down from the male along an arc. It should be understood, however, that the sitting position a,a can be moved rearwardly closer to the horizontal pivot axis x,x than is shown in FIGS. 1, 2 and 5. It is only desirable that at least a portion of the sitting surface extend forwardly beyond the axis x,x though preferably, the sitting surface when positioned primarily or entirely in front of the axis x,x permits the greatest amount of travel and flexibility for the female occupant. It has been found that the sitting surface of the female seat should be as thin as possible to promote mutual contact and except for this small area and its remote abutting surface to the male torso, the interruption of contact is minimal, and in fact promotes free movement of the female hips as they rotate over the male legs.

Remote from the pivot axis x,x and at the leading ends 79,79 of the upper leg supports 76,76 is an important element of the present invention. As shown best in FIGS. 1, 3 and 5, each upper leg support 76 is provided with a leg restraint 80. As shown, each leg restraint is integral with the respective leg support 76 and it is constructed so that it is raised up from the surface of each upper leg support 76 in a gentle curve as shown at 82 then overlaps in a reverse curve 84 the upper leg 76 to provide a restraining surface 86 best shown in FIGS. 1, 3 and 5 to receive and hold the upper thigh of the seated female as the tip 88 overlaps the leg of the seated female. The restraining surface 86 is designed to have a contour that conforms generally to the size and shape of the upper thigh of the female so that the restraining surface 86 will provide a comfortable yet rigid supporting surface to restrain the female while she is seated in the sitting surface a,a and is leaning forwardly. The female shall sit and be retained by the seat as she sits out to the farthest forward part of the leg restraint 80. As the leg restraint 80 curves up and over the leg of the female seat occupant, the opposite side of the overlapping portion forms an abutting surface 89 that is designed to come into contact with the torso of the male seated below and in front of the female. This seat design provides a means for uninterrupted contact between the couple from the genitals upwardly.

Another important feature of the present invention is the open center 90 that is formed between the upper leg supports 76,76 and which is important for the mutual access between the sexual partners seated in the seats 12 and 14.

The seated female sits comfortably on the seat 12 with her legs apart at an approximate 45° angle with her buttocks supported and her legs positioned to straddle the seated male while she is capable of tilting arcuately forwardly from an upright position as is shown on the right side of FIG. 2 where the seat 12 may tilt or pivot about the horizontal axis 74 or x,x down from a horizontal plane at least 30°. As shown on the left side of FIG. 2 the seat may tilt rearwardly at least 20° from the horizontal plane.

The male seat as best shown in FIGS. 1, 2, 4, 5 and 8 may have a similar pivoting support to that of the female seat. However, the deep open center 90 of the female seat is not necessary for the seated male which has buttocks supporting area 92 and leading edges 94,94 of the seat for each leg as shown. The male seat may have similar movement controlling structure as described for the female seat 12 though the U-shaped yoke 63 is shown in FIG. 11 to be continuous for the male seat. It is permitted to tilt forwardly and backwardly about its axis 74*a* previously described and may move vertically with the same pedestal 46 and stanchion 42 arrangement also as previously described for the female seat or may be restricted from such vertical movement. The male sitting surface may be positioned somewhat forwardly of the pivot axis 74*a* or even pivotable in a customary manner. It is not desirable for him to have as great an arc to travel about. In addition, the movement along the horizontal is permitted by means of the dolly 40 also as previously described in connection with the movement of the female seat.

A rigid nonextensible limit cord or chain 95 may be positioned to the U-shaped plate 54 at one end and at the other end secured at 95*a* to the backplate 96 formed integrally with backrest 16 of the female seat in order to limit the tilting travel of the forward motion of the female occupant.

In order to permit the male to vary his longitudinal position with only the requirement of his pushing rearwardly with his feet or hands, the male seat is preferably connected to a flexible extensible cord 97, at one end to the movable male seat dolly 40 as shown at 98 and at other end 100 to the fixed rail 20 so that there is a constant gentle urging of the male dolly 40 towards the female dolly 40 from the cord 97. This cord may run through the center of the rail.

In order to provide comfort and provide a sensation of floating or levitating, the female seat and also the male seat may be counterbalanced with resilient flexible cords shown at 102 for the female seat which are embedded at opposite ends in retainer bars 103,103 that are each provided with opposed protruding stub rods 104 that are received within hooks 58,58 at one end and at the other end are secured to protruding brackets 104,104 provided with opposed slots 106. Thus as the female leans forwardly of the horizontal axis x,x of her seat 12, the flexible cord 102 is stretched to gently reverse her motion and provide her with the feeling of floating as the cord 102 may be designed to require the use of significant force for the female to resist her forward movement.

Similarly, the male seat, as shown in FIGS. 8 and 11, is provided with flexible bands or cords 108,108 secured to the bottom of male seat 14 at 110 and the dolly 40 at 112 or alternatively may have connected thereto a dash pot or such other resilient means in lieu of the cords or bands 108,108.

With the structure of the invention so described it should be clear that the female seated in the female seat 12 has sexual access to the lower seated male in part due to the overlapping of the leading edges of the seats. Her legs are positioned to straddle the male torso while tilting arcuately forwardly and downwardly on axis x,x against counterbalancing resistance from the upright up to 30° or more. The seat shall safely retain her, even as she forces herself as forwardly as possible against the contoured, yet rigid restraint, and this promotes the active use of musculature associated with her sexual organ. The depth and width of the open center 90 being wide enough to permit sexual access of the male and the abutting surface 89 is desirable to contact the upper torso of the male however the opening 90 is designed to be too small for the male to stand fully within. As the female shifts her weight forwardly she may comfortably straddle her male partner with her feet on the ground, or not, as she may choose and she is then able to raise and lower her sex organ approximately 6 to 10 inches along an arc generated by the pivoting about the axis x,x.

Obviously changing or modifying the extension brackets 70,70 to provide a longer or shorter distance from the pivoting axis x,x will allow a greater or lesser arc or arcuate path to be taken by the female as she is seated in the seat 12. A given point on the seat sitting surface will generate a very substantial spherical surface through such movement. This arc may be varied by means of simultaneous longitudinal movement, or even the optional up and down motion that may be permitted pedestal 46.

The female is then able to reciprocate along an arcuate path permitting greater or lesser penetration of the male sexual organ into her own sexual organ and at the same time she may move horizontally with the assistance of the dolly 40 beneath her seat into deeper or lesser penetration by the male. At the same time the male is able to move his sexual organ along an arc that may be similar or not similar to the arc taken by the female and he is capable of moving along a horizontal path by reason of the dolly beneath the male seat 14 and can tilt about the axis 74*a* to join with his female partner into a joint rotating action both counterbalanced as they move together or a coordinated stroking action should either or both desire to do so. It is desirable that the female sitting surface overlap the male seated in the male seat with the abutting surface 89 contacting the male torso so that the female may reciprocate along an arcuate path toward and away from the male and at the same time along a horizontal path toward and away from the male. These actions do not have to be performed simultaneously although it is possible to do so. It is entirely within the control of the female to choose the type and manner of movement that she wishes.

Although the machine provides a means for enormous controlled movement of a couple engaged in coitus, it should be pointed out that the couple so engaged may also create and experience delicate motions more efficiently than has previously been humanly attainable and effortlessly repeatable. Mutual buoyancy, ease of access and means of efficient motion make gravitational forces work for the benefit of sexual union. Reduced friction to the male organ by the reduced effective weight of the two counterbalanced bodies may permit the male greater ejaculatory delay and prolonged sexual union.

The human sexual fitness machine presented herein is in the format of a contemporary exercise machine, and is dedicated to reduction of energy demands thereby providing a couple with a means to actively participate where conventional means or methods might be too taxing altogether, and thus, a means of increased fitness for sexual union is achieved.

Additionally, it is obvious that motorizing any of the means of motion as previously detailed may be useful for some couples suffering from certain disabilities.

We claim:

1. A human sexual fitness machine to assist a human male and female couple to engage in sexual intercourse with reduced effect of gravity or the reduced expenditure of substantial energy comprising:

a seat for each of said female and male of said couple operatively associated with said machine, said male and female seats positioned to substantially face each other, means positioned on said machine for reciprocating movement of the female seat independently of the male seat and selectively continually toward and away from the male seat, means positioned on said machine and connected to the female seat for independently and selectively continually pivoting said female seat about a horizontal axis relative to the other seat, whereby said couple seated upon said seats may control their engagement in sexual intercourse while substantially supported by the seats thereby reducing the amount of energy required or the body control necessary.

2. The machine of claim 1 including, said means for reciprocating movement and said means for pivoting said female seat being capable of selective simultaneous and continuous pivoting and reciprocating movement.

3. The machine of claim 1 including, said means for pivoting being so structurally arranged so as to permit a given point on the plane of said female seat to generate selectively continually a spherical surface.

4. The machine of claim 3 including, said reciprocating movement and said generation of a spherical surface being selectively performed simultaneously.

5. The machine of claim 1 including, said means for reciprocating movement moving said female seat along a substantially horizontal path, said female seat being bifurcated and having an open center, and said female seat being positionable above and substantially overlapping said other seat.

6. The machine of claim 1 including, said female seat being bifurcated and having an open center.

7. The machine of claim 6 including, said female seat having a female sitting surface thereon, and said sitting surface being positioned substantially forwardly of said horizontal axis.

8. The machine of claim 1 including, said female seat being bifurcated and having an open center, and said female seat also including a pair of upper leg supports for a seated female spaced apart forming said open center.

9. The machine of claim 8 including, said female seat positionable above and substantially overlapping the male seated in said other seat.

10. The machine of claim 9 including, said male and said female seats each having at least one leading edge, leading edge of said female set being able to overlap that of the male seat.

11. The machine of claim 8 including, said female seat having restraint means operatively connected to said female seat for restraining a seated female.

12. The machine of claim 11 including, said restraint being constructed to overlay the upper leg of said seated female.

13. The machine of claim 12 including, said leg restraint being integral with said upper leg support.

14. The machine of claim 11 including, said leg restraint having an abutting surface remote from said female for contact with the male in said male seat.

15. The machine of claim 1 including, said female seat being bifurcated and having an open center, said female seat also including a pair of upper leg supports for a seated female spaced apart forming said open center, said female seat positioned above and substantially overlapping the male seated in said other seat, and said female seat having at least one restraint means operatively connected to said female seat for restraining a seated female.

16. The machine of claim 1 including, said female seat being bifurcated and having an open center, said female seat also including a pair of upper leg supports for a seated female spaced apart forming said open center, said female seat positioned above and substantially overlapping the male seated in said other seat, said female seat having at least one restraint means operatively connected to said female seat for restraining a seated female, and said restraint being constructed to overlay the upper leg of said seated female.

17. The machine of claim 1 including, said female seat being bifurcated and having an open center, said female seat also including a pair of upper leg supports for a seated female spaced apart forming said open center, said female seat positioned above and substantially overlapping the male seated in said other seat, said female seat having at least one restraint means operatively connected to said female seat for restraining a seated female, said restraint being constructed to overlay the upper leg of said seated female, said female seat having a female sitting surface thereon, and said sitting surface being positioned substantially forwardly of said horizontal axis.

18. The machine of claim 1 including, counterbalancing means connected to the female seat to balance the weight of occupant on said seat during said pivoting as it pivots forward about a horizontal axis.

19. The machine of claim 1 including, said female seat being bifurcated and having an open center, said female seat also including a pair of upper leg supports for a seated female spaced apart forming said open center, said female seat positionable above and substantially overlapping the male, said female seat having at least one restraint means operatively connected to said female seat for restraining a seated female, and counterbalancing means connected to the female seat to balance the weight of the occupant on said seat during said pivoting forward about a horizontal axis.

20. A human sexual fitness machine to assist a human male and female couple to engage in sexual intercourse with reduced effect of gravity or the reduced expenditure of substantial energy while inducing improved sexual fitness comprising:

a seat for each of said female and male of said couple operatively associated with said machine, said male and female seats positioned to substantially face each other, means positioned on said machine for reciprocating movement of the female seat independently of said male seat and selectively continually toward and away from the male seat along a substantially arcuate path about a horizontal axis, whereby said couple seated upon said seats may control their engagement in sexual intercourse while substantially supported by the seats thereby reducing the amount of energy required or the body control necessary.

21. The sexual fitness machine of claim 20 including, separate means for reciprocating movement of said female seat along a substantially horizontal path.

22. The machine of claim 20 including, said female seat being bifurcated and having an open center.

23. The machine of claim 20 including, said female seat being positionable above and substantially overlapping said other seat.

24. The machine of claim 20 including, said means for reciprocating movement including pivot means to direct said female seat arcuately toward and away from said other male seat.

25. The machine of claim 24 including, said pivot means having a horizontal pivot axis.

26. The machine of claim 20 including, said female seat being bifurcated and having an open center, and said female seat being positionable above and substantially overlapping said male seat.

27. The machine of claim 20 including, said female seat being bifurcated and having an open center, and said means for reciprocating movement including pivot means to direct said female seat arcuately toward and away from said other seat.

28. The machine of claim 20 including, said female seat being bifurcated and having an open center, said female seat being positionable above and substantially overlapping said male seat, and said means for reciprocating movement including pivot means to direct said female seat arcuately toward and away from said male seat.

29. The machine of claim 20 including, separate means for reciprocating movement of said female seat along a substantially horizontal path, and said female seat being bifurcated and having an open center.

30. The machine of claim 20 including, separate means for reciprocating movement of said female seat along a substantially horizontal path, said female seat being bifurcated and having an open center, said female seat being positionable above and substantially overlapping said male seat, said means for reciprocating movement including pivot means to direct said female seat arcuately toward and away from said male seat.

31. The machine of claim 20 including, said female seat being bifurcated and having an open center, said female seat also including a pair of upper leg supports for a seated female spaced apart forming said open center.

32. The machine of claim 20 including, said female seat being bifurcated and having an open center, said female seat also including a pair of upper leg supports for a seated female spaced apart forming said open center, and said female seat positionable above and substantially overlapping the male seated in said male seat.

33. The machine of claim 20 including, said female seat having a female sitting surface thereon, and said sitting surface being positioned substantially forwardly of said horizontal axis.

34. The machine of claim 20 including, said female seat being bifurcated and having an open center, said female seat also including a pair of upper leg supports for a seated female spaced apart forming said open center, said female seat positionable above and substantially overlapping the male, and said female seat having at least one restraint means operatively connected to said female seat for restraining a seated female.

35. The machine of claim 20 including, said female seat having a female sitting surface thereon, said sitting surface being positioned substantially forwardly of said horizontal axis, said female seat being bifurcated and having an open center, said female seat also including a pair of upper leg supports for a seated female spaced apart forming said open center, said female seat positionable above and substantially overlapping the male, and said female seat having at least one restraint means operatively connected to said female seat for restraining a seated female.

36. The machine of claim 20 including, counterbalancing means connected to at least the female seat to balance the weight of the occupant on said seat during said reciprocating movement along a substantially arcuate path as it pivots forward about a horizontal axis.

37. The machine of claim 20 including, said female seat having a female sitting surface thereon, said sitting surface being positioned substantially forwardly of said horizontal axis, and counterbalancing means connected to at least the female seat to balance the weight of the occupant on said seat during said reciprocating movement along a substantially arcuate path.

38. A seat for a female in a human sexual fitness machine comprising, a bifurcated planar seat forming a pair of seat legs and an open center, a sitting surface on said seat, said seat legs for supporting a seated female, a restraint formed in said seat legs for restraining the legs of a seated female, and said restraint rising above said planar seat to engage and overlay the upper leg of the seated female.

39. The seat of claim 38 including, pivot means positioned and connected to said seat to permit pivoting of said seat and allow said female to move in an arcuate forward path.

40. The seat of claim 39 including, a sitting position within said sitting surface, and said sitting position situated substantially forward of said pivot means.

41. The seat of claim 39 including, counterbalancing means connected to said seat to balance the weight of said female during movement in said arcuate path as pivots forward.

42. The seat of claim 38 including, pivot means positioned and connected to said seat to permit pivoting of said seat and allow said female to move in an arcuate path forward, a sitting position within said sitting surface, said sitting position situated substantially forward of said pivot means, and counterbalancing means connected to said seat to balance the weight of said female during forward movement in said arcuate path.

43. The method of assisting a human male and female couple to engage in sexual intercourse with reduced effect of gravity or the reduced expenditure of substantial energy by either person comprising, providing a male and female seats for said couple on a stationary machine, supporting said male and female couple on their respective male and female seats, facing said male and female seats toward each other, reciprocating at least the adult size female seat independently of said male seat and selectively continually toward and away from each other along an arcuate path about a substantially horizontal axis, allowing at least the female of said couple to control said reciprocating during said sexual intercourse.

44. The method of claim 43 including, simultaneously, independently and selectively continually reciprocating at least the female seat toward and away from the male seat along a horizontal path.

45. The method of claim 43 including, permitting said reciprocating of said female seat along an arcuate path forward by pivoting to selectively continually generate a spherical surface by a given point on the plane of said seat.

46. The method of claim 43 including, providing said female seat with upper leg supports for a seated female and forming an open center.

47. The method of claim 43 including, positioning said female seat above and substantially overlapping said male seat.

48. The method of claim 43 including, restraining at least one leg of a seated female to said female seat.

49. The method of claim 43 including, forming a female sitting surface on said female seat, and positioning said female sitting surface forwardly of said horizontal axis.

50. The method of claim 43 including, counterbalancing the female seat to balance the weight of an occupant of said seat during movement along an arcuate path forward and downward.

51. The method of claim 43 including, simultaneously, independently and selectively continually reciprocating at least the female seat toward and away from the male seat along a horizontal path, providing said female seat with upper leg supports for a seated female and forming an open center, and restraining at least one leg of a seated female to said female seat.

52. The method of claim 43 including, permitting said reciprocating of said female seat along an arcuate path by pivoting to selectively continually generate a spherical surface by a given point on the plane of said seat, providing said female seat with upper leg supports for a seated female and forming an open center, restraining at least one leg of a seated female to said female seat, forming a female sitting surface on said female seat, and positioning said female sitting surface forwardly of said horizontal axis.

53. The method of claim 43 including, simultaneously, independently and selectively continually reciprocating at least the female seat toward and away from the male seat along a horizontal path, permitting said reciprocating of said female seat along an arcuate path by pivoting to selectively continually generate a spherical surface by a given point on the plane of said seat, providing said female seat with upper leg supports for a seated female and forming an open center, positioning said female seat above and substantially overlapping said male seat, restraining at least one leg of a seated female to said female seat, forming a female sitting surface on said female seat, positioning said female sitting surface forwardly of said horizontal axis, and counterbalancing the female seat to balance the weight of an occupant of said seat during movement along an arcuate path forwardly, and forming a surface on the leading edge of the female seat remote from said female and abutting said surface against the male torso.

54. The method of claim 43 including, counterbalancing both seats to balance the weight of each occupant of each seat during movement along an arcuate path for each seat, simultaneously rotating each seat and its occupant along respective arcuate paths.

55. The method of claim 20 including, simultaneously, independently and selectively continually reciprocating at least the female seat toward and away from the male seat along a horizontal path.

56. The method of claim 20 including, simultaneously, independently and selectively continually reciprocating each seat toward and away from the male seat along a horizontal path.

57. A human sexual fitness machine to assist a human male and female couple to engage in sexual intercourse with reduced effect of gravity or the reduced expenditure of substantial energy comprising:

a seat for each of said female and male of said couple operatively associated with said machine, said male and female seats positioned to substantially face each other, means positioned on said machine for movement of said female seat in a substantially horizontal direction to overlap said male seat permitting said female in said female seat to position her torso above and beyond the leading edge of said male seat, and means to selectively continually urge said male seat toward said female seat during said movement of said female seat to overlap said male seat whereby the male in said male seat may be in continuous contact with and below the female in said female seat during said movement.

58. The method of assisting a human male and female couple to engage in sexual intercourse with reduced effect of gravity or the reduced expenditure of substantial energy by either person comprising, providing a male and female seat for said couple on a stationary machine, supporting said male and female couple on their respective male and female seats, facing said male and female seats toward each other, moving said female seat in a substantially horizontal direction to overlap said male seat, permitting said female in said female seat to position her torso above and beyond the leading edge of said male seat, selectively continually urging said male seat toward said female seat during said movement of said female seat to overlap said male seat, and permitting the male in said male seat to be in continuous contact with and below the female in said female seat during said movement.

* * * * *